US008911564B2

(12) United States Patent
Hatten

(10) Patent No.: US 8,911,564 B2
(45) Date of Patent: Dec. 16, 2014

(54) WELL CLEANING APPARATUS

(76) Inventor: Paul Robert Hatten, Carlsbad, CA (US)

( * ) Notice: Subject to any disclaimer, the term of this patent is extended or adjusted under 35 U.S.C. 154(b) by 697 days.

(21) Appl. No.: 12/375,735

(22) PCT Filed: Aug. 3, 2007

(86) PCT No.: PCT/AU2007/001083
§ 371 (c)(1),
(2), (4) Date: Jan. 30, 2009

(87) PCT Pub. No.: WO2008/014559
PCT Pub. Date: Feb. 7, 2008

(65) Prior Publication Data

US 2009/0308595 A1 Dec. 17, 2009

(30) Foreign Application Priority Data

Aug. 4, 2006 (AU) ..... 2006904218

(51) Int. Cl.
*B08B 9/00* (2006.01)
*E03B 3/15* (2006.01)
*E03F 5/04* (2006.01)

(52) U.S. Cl.
CPC ..... *E03B 3/15* (2013.01); *E08B 9/0813* (2013.01); *E03F 5/0402* (2013.01)
USPC ..... 134/168 R

(58) Field of Classification Search
USPC ..... 134/166 R, 167 R, 168 R, 167 C, 169 R, 134/169 C, 166 C
See application file for complete search history.

(56) References Cited

U.S. PATENT DOCUMENTS

| | | | | |
|---|---|---|---|---|
| 1,545,896 | A * | 7/1925 | Hanlon | 134/167 R |
| 3,107,860 | A * | 10/1963 | Umbricht | 239/521 |
| 3,113,046 | A * | 12/1963 | Reddick et al. | 134/24 |
| 4,431,232 | A | 2/1984 | Hannouche | |
| 5,038,810 | A | 8/1991 | Pacheco et al. | |
| 6,868,857 | B2 | 3/2005 | McCasker | |
| 2004/0238009 | A1 * | 12/2004 | Falster-Hansen et al. | 134/22.1 |

FOREIGN PATENT DOCUMENTS

| | | |
|---|---|---|
| AU | 39856/93 | 12/1994 |
| WO | WO0158605 | 8/2001 |

OTHER PUBLICATIONS

Aqua Machineries PVT Ltd, Aqua ANS non-clog sewage submersible pump advantages, technical description (Feb. 11, 2005) (retrieved on Oct. 16, 2007, from the internet http://web.archive.org/web/20050211002249/aquapumps.com/advantages.html).

Pumpbiz.Com, Barnes series 3SE-L non-clog submersible sewage pump description and 3SE1594L Technical Specification (Jun. 19, 2006) (retrieved on Oct. 16, 2007, from the internet http://web.archive.org/web/20060619081746/http://www.pumpbiz.com/products/index.cfm?fuseaction=pump_series&series_id=526).

* cited by examiner

*Primary Examiner* — David Cormier
(74) *Attorney, Agent, or Firm* — McHale & Slavin, P.A.

(57) ABSTRACT

A well cleaning apparatus comprises water jets rotating on a vertical feed conduit which is rotatably mounted at the top of the well and fed by a stream of fluid pumped from the well by a submersible pump. The apparatus has a housing attached above the inlet pipe to hold an atomizer which allows a deodorizing vapor to be drawn into the conduit by the feed stream. The water jets have deflectors mounted at the end of the jets to direct the effluent being pumped through them.

22 Claims, 5 Drawing Sheets

WELL CLEANING APPARATUS

CROSS REFERENCE TO RELATED APPLICATIONS

This is a national stage filing in accordance with 35 U.S.C. §371 of PCT/AU2007/001083, filed Aug. 3, 2007, which claims the benefit of the priority of Australia Patent Application No. 2006904218, filed Aug. 4, 2006.

FIELD OF THE INVENTION

This invention relates to a device for cleaning wells including sumps, holding tanks, grease traps and sewage pits.

BACKGROUND OF THE INVENTION

Sewage systems are in wide spread use for the removal of liquid waste from houses, factories and agricultural sites. The sewage flows through pipes into intermediate wells and finally into treatment plants or waste dumps. Electric pumps are usually used to maintain the flow and keep the wells below maximum capacity. These pumps are configured to operate when the level in the wells reaches a preset limit indicating that the flow needs pumping.

When the well level falls to a minimum level the pump is switched off and this level may be maintained for some time leaving a biofilm residue on the walls of the well between the maximum and minimum levels. This residue tends to harden and build up thus reducing the capacity of the well, and increasing the frequency of the pump operation.

Wastewater collection and treatment systems are a source of bad odors, the most prevalent coming from Hydrogen Sulphide, a toxic and corrosive gas with a characteristic rotten-egg smell. This is a bacterially mediated process that occurs in the submerged portion of sanitary sewerage systems. It begins with the establishment of a slime layer below the water level, composed of bacteria and other inert solids held together by a biologically secreted protein "glue" or biofilm called zooglea. When this biofilm becomes thick enough to prevent the diffusion of dissolved oxygen, an anoxic zone develops under the surface.

Hydrogen Sulphide is also a precursor to the formation of Sulphuric Acid, which causes the destruction of metal and concrete substrates and appurtenances within wastewater facilities and collection stations. The effect of biogenic sulfide corrosion and the formation of a 7% Sulphuric Acid solution on concrete surfaces exposed to the sewer environment are devastating. Entire pump stations and manholes and large sections of collection interceptors have collapsed due to the loss of structural integrity in the concrete.

Accordingly the residue must be cleaned off the well walls and removed from the surface of the sewer water periodically to maintain the system in good working order as well as protecting concrete structures against the biogenic sulfide corrosion in wastewater collection and treatment systems so as to met the structure's anticipated design life as well as protecting the surrounding ground level infrastructure and environment.

Manual cleaning of wells is time consuming, expensive and dirty work and a number of devices have been developed to automate and reduce the cost of cleaning. For example U.S. Pat. No. 4,431,232 teaches apparatus with a spray head comprising spray arms which are rotated about a vertical axis by a shaft driven by a motor and are rotated about a horizontal axis. As well as the complex gearing for the spray head the apparatus also requires a feed stream of pre-heated water and a chemical cleansing liquid. As the apparatus has still to be manually operated in the well it is a costly solution to the problem of cleaning sewage wells.

Another apparatus is disclosed in WO 01/58605 which is permanently mounted in the well on a support arm and connected to a cleaning liquid supply which is turned on and off by liquid control valves operated by level sensors in the well. However this apparatus still requires a separate cleaning liquid supply and uses a large volume of water which must be supplied from often scarce potable water sources.

U.S. Pat. No. 6,868,857 teaches a precursor apparatus to the present invention which is also permanently mounted in the well. It has a number of modifications aimed at making the wall cleaning action more effective and also has a deodorizing function. However the apparatus is still not completely effective and periodic manual cleaning of the well walls and maintenance of the apparatus requires time consuming dismantling and reassembly. The apparatus also still requires a large volume of water from an external supply of often scarce potable water.

It will be noted that U.S. Pat. No. 6,868,857 also teaches the use of the sewage in the well to feed the cleaning apparatus. However the latter system employs filters to remove solids from the sewage which is drawn into the submersible pump for pumping into the feed steam. But these filters quickly become clogged and the pump becomes ineffective and the apparatus reverts to using the external water supply. Further this method of using filtered effluent is not effective in chopping up and removing the biofilm construction.

Object of the Invention

It is therefore an object of the present invention to provide apparatus which overcomes or at least significantly reduces problems relating to the cleaning of wells by the prior art systems. In particular the present invention employs spray nozzles and a submerged pumping system which allows the apparatus to use the sewage in the well to clean the walls causing aeration of the introduced effluent, hydrating the grease, oils, fats that contribute to biofilm so that it can be easily transported, via the sewer system to treatment plant for treatment. This requires a system which can use a liquid stream containing solid materials which prior art apparatus has not achieved. A further object is to provide apparatus at well openings, removing the need for confined space entry, which can be easily repositioned from the well entry point to allow access to the well to facilitate maintenance.

STATEMENT OF THE INVENTION

According to the present invention there is provided well cleaning apparatus comprising water jets rotating on a vertical feed conduit which is rotatably mounted at the top of the well and fed by a stream of fluid.

Preferably the vertical feed conduit is offset to extend away from the wall into the centre of the well.

Preferably the device is fed by effluent pumped from the well by a submersible pump up into an inlet pipe in the feed conduit above the offset.

Preferably the feed conduit has a telescopic extension in the section below the offset.

Preferably the feed conduit has a housing attached above the inlet pipe to hold deodorizer or formulas such as enzymes, which allow the deodorizer vapor to be drawn into the conduit by the feed stream thus achieving a mix with the incoming effluent and removing sedimentation at the base of the well.

Preferably the water jets rotate about a bearing or rotary union mounted at the base of the vertical feed conduit.

Preferably the water jets have hang up free deflectors mounted at the end of the jets to direct the effluent being pumped through them.

Preferably the deflectors are 360 degree rotational controlled manually or by pressure sensors which control the speed of rotation and direction of spay depending on pressure and flow.

Preferably the mounting of the apparatus at the top of the well is close to the well access and contains a swivel mechanism which allows rotation of the apparatus from one side to the other to facilitate access to other components in the well.

Preferably atomizing jets are provided which deliver oxidation-based atomized vapor at ambient temperature and at various gph, which neutralize Hydrogen Sulphide gas activity in the headspace above the waterline in wastewater pipes and structures and are programmed to activate at various peak times.

BRIEF DESCRIPTION OF THE DRAWINGS

Various embodiments of the invention are now described by way of example only, with reference to the accompanying drawings in which.

DETAILED DESCRIPTION OF THE INVENTION

Figure 1:
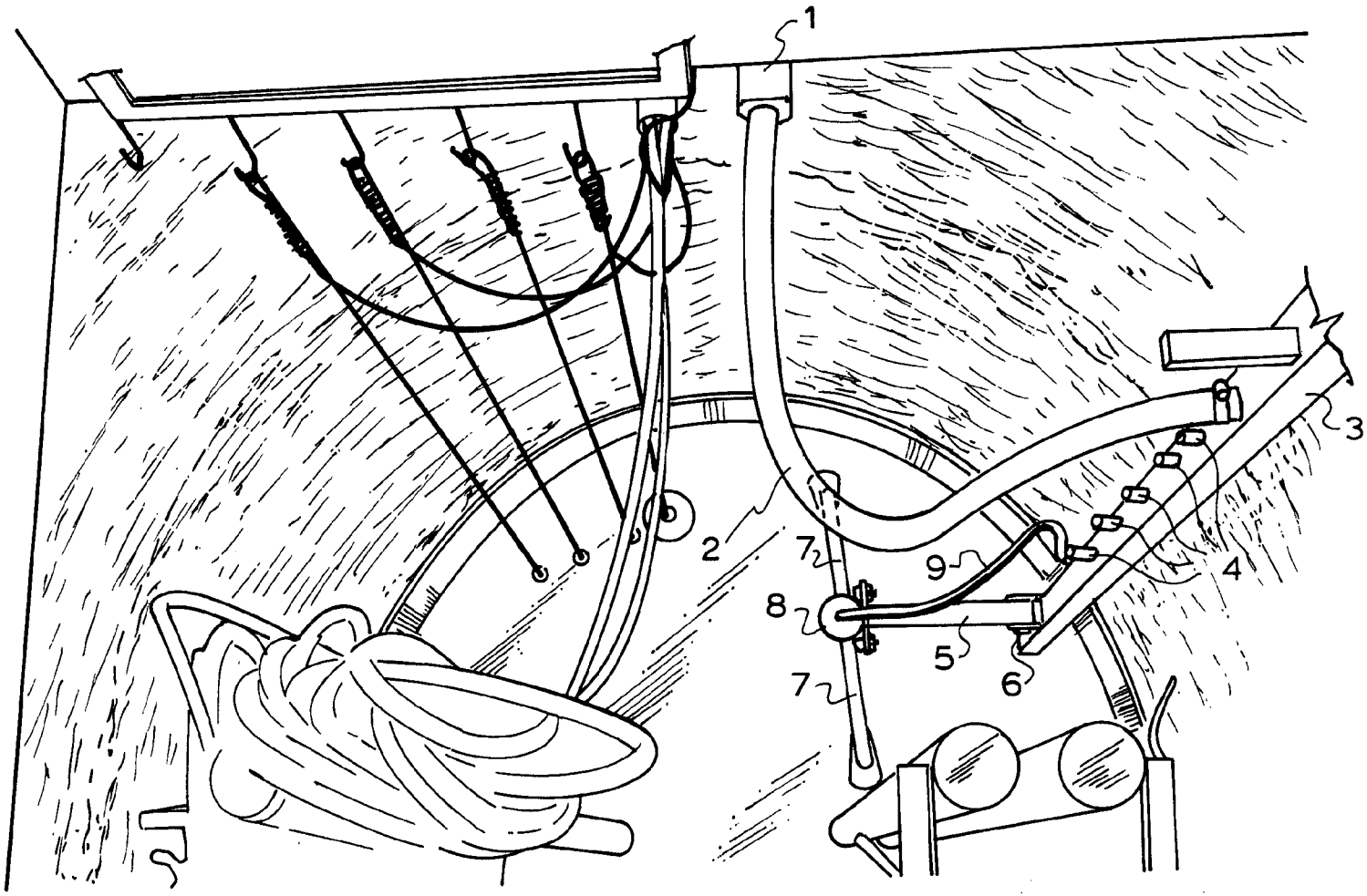
FIG. 1 is a perspective view looking down a well with cleaning apparatus mounted at the top of the wall.

FIG. 1 shows a cleaning apparatus mounted on bracket 11 at the top of the well wall. Water is fed from an external source 1 via a hose 2 to a vertical feed conduit 3. Jets 4 are mounted on the face of conduit 3 looking into the centre of the well. At the bottom of conduit 3 arm 5 is pivoted about bracket 6. At the free end of arm 5 rotating water jets 7 are mounted on bearing or vertical load rotary union 8 and rotate under the pressure of water supplied by hose 9 from conduit 3. Accordingly, when operating, jets 4 and 7 spray the walls of the well, the surface of the sewer water in the well and also the other equipment in the well. Arm 5 can be rotated upwards, left or right to retract rotating jets 7 to the side of the well to provide free access for well maintenance.

Figure 2:
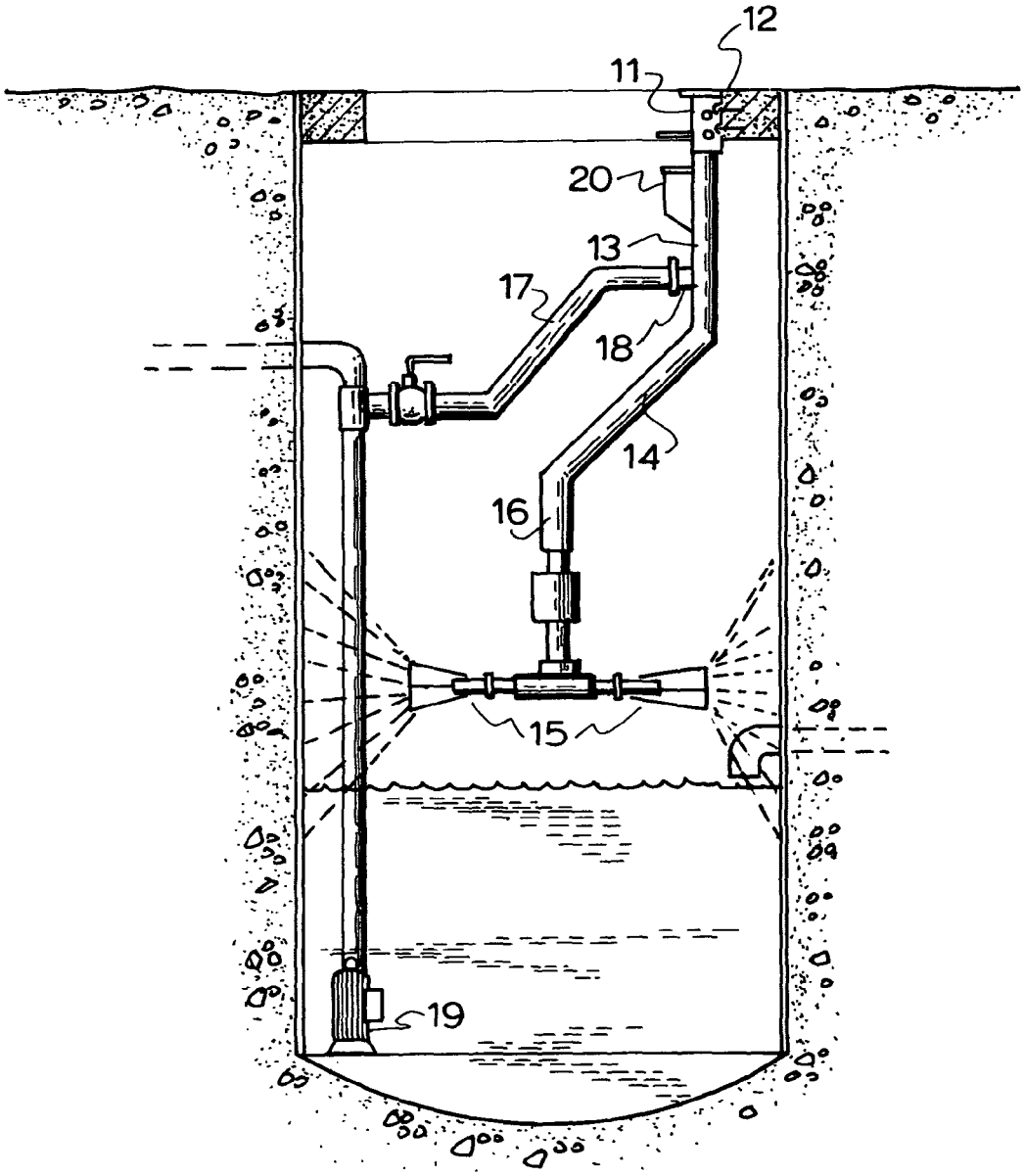
FIG. 2 is an elevation view of a cleaning device mounted in a well

FIG. 2 illustrates alternative cleaning apparatus mounted in a well by bracket 11 fixed to rim 12 of the well. Conduit 13 of the device is offset at 14 so that spray jet arms 15 which rotate about lower end 16 of conduit 13 are at the centre of the well. Hose 17 feeding spray jet arms 15 connects to conduit 13 at inlet 18. Hose 17 can be fed by an external source of water or by effluent pumped from the well by existing submersible pump or introduced submersible pump in the case of a low flow system 19. Pump 19, conduit 13, offset 14 and jet arms 15 are designed to allow passage of a sewage stream containing solids up to 50 mm in diameter and 90 mm long.

Figure 3:
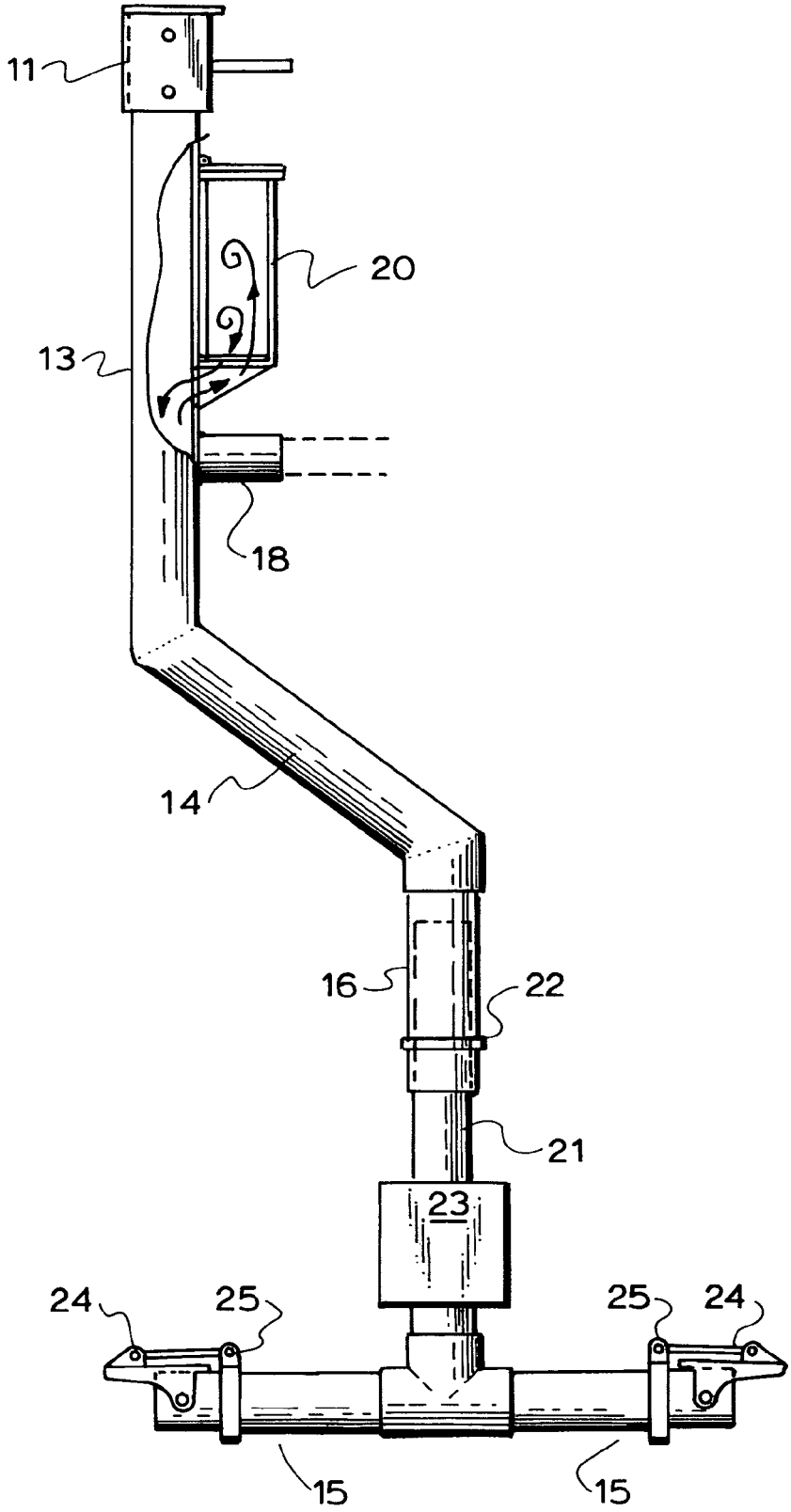
FIG. 3 is an enlarged elevation of the device of FIG. 2

FIG. 3 shows the apparatus suspended by bracket 11 which contains a swivel mechanism allowing the apparatus to be rotated to either side of the well. Feed mast 20 contains an atomizer which is attached to and communicates with conduit 13 allowing vapor to be drawn in to the feed stream entering through inlet 18. At a predetermined level a sensor communicates with a solenoid valve which activates the atomizers to inject a micron spray discharge of water, enzyme and deodoriser into the feed stream which captures hydrogen sulphide and other noxious gases. The acid content of these gases is liquefied, neutralized and recycled in the feed stream.

The conduit below offset 14 has a telescopic extension 21 which slides inside conduit 16 and is clamped at the required extension by clamp 22. This can be adjusted manually or can be activated by a level sensor that at a predetermined height above the sewer surface level will adjust its height to remain at the set inputted height above the water surface. The level sensor communicates with the mechanical drive that then adjusts the height to suit the water level.

Figure 4:
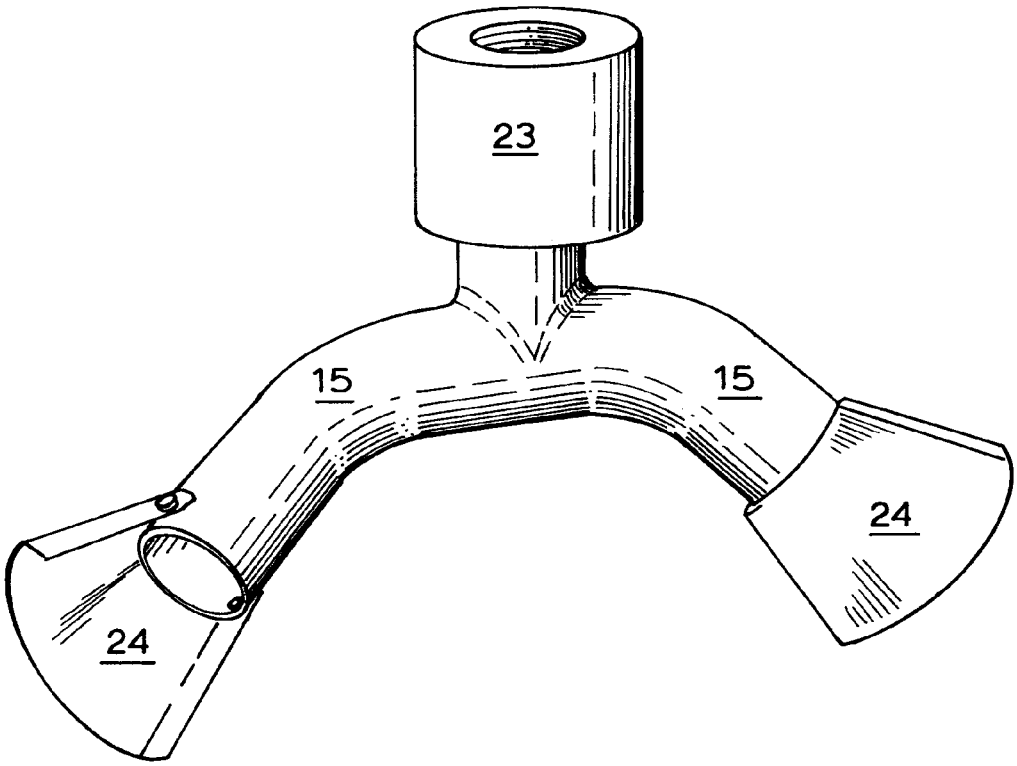
FIG. 4 is a detailed view of a spray jet head.
Figure 5:
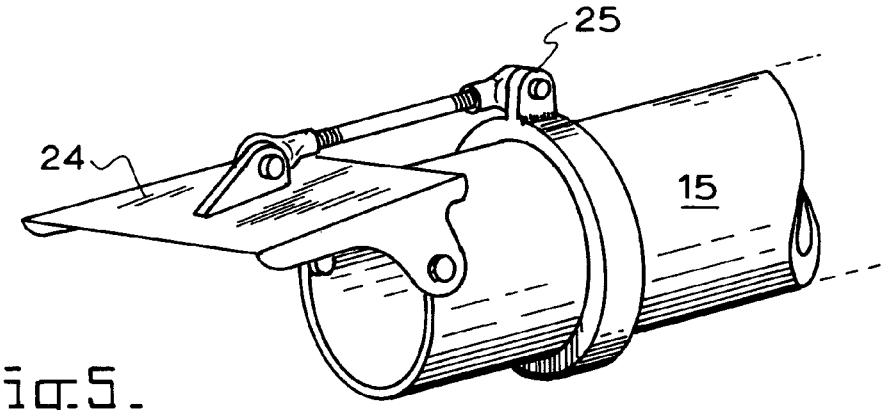
FIG. 5 is a detailed view of a deflector mounted on the spray jet head of FIG. 4 and FIGS. 6 and 7 illustrate alternative deflectors.
Figure 6:
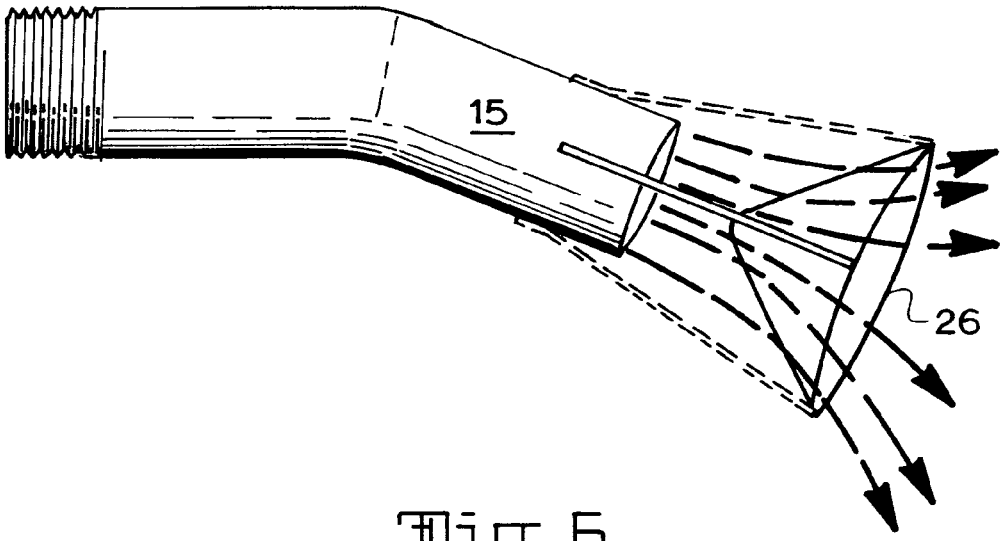
Figure 7:
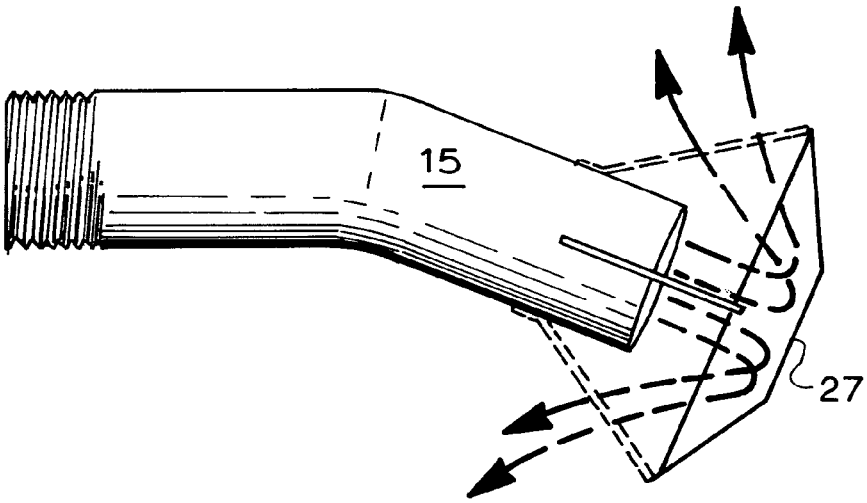

FIG. 4 shows the detail of spray jet arms 15 which are mounted on extension 21 via bearing/vertical load rotary union 23 and rotate under the tangential force generated by the jets. The latter are deflected to spray onto the required section of the well wall by deflectors 24, the angle of which can be changed by adjusting collars 25. Alternative deflectors in the shape of cones, 26 and 27, are shown in FIGS. 6 and 7.

The fluid supply to the cleaning device is operated automatically by solenoids and sensor switches which detect the level of sewage in the well. When the level falls below a preset minimum the supply is activated and the jets rotate spraying the residue left on the well walls and sewer water surface. When the level rises to a preset maximum the supply is shut off and the sprays cease. Accordingly the well walls are automatically kept free of residue. Further since effluent from the well is pumped through the device the cleaning is achieved without the use of any external supply of clean water.

VARIATIONS

It will be realised that while the foregoing has been given by way of illustrative example of this invention, all such and other modifications and variations thereto as would be apparent to persons skilled in the art are deemed to fall within the broad scope and ambit of this invention as is herein set forth. For example it will be clear that the turbine could have more than two radial arms and water jets and brushes providing they are balanced. It will also be clear that the procedure for cleaning can be varied.

Throughout the description and claims this specification the word "comprise" and variations of that word such as "comprises" and "comprising", are not intended to exclude other additives, components, integers or steps.

The invention claimed is:

1. A well cleaning system comprising a fluid having solid materials and an apparatus comprising water jets positioned above the surface of said fluid comprising solid materials stored within a confined space of a well, said water jets secured to a vertical feed conduit mounted at the top of said well, said water jets fluidly coupled to a submersible pump through a hose feed connected to said vertical feed conduit and adapted to direct a stream of said fluid comprising solid materials pumped directly from said well without filtering to said water jets, whereby said stream of unfiltered fluid is directed to spray portions of said well above the surface of said fluid.

2. The well cleaning system of claim 1 in which an offset extends the vertical feed conduit away from a well wall into the center of the well.

3. The well cleaning system of claim 2, wherein the water jets are fed by pumping said fluid from the well into the feed conduit above the offset.

4. The well cleaning system of claim 2 in which the fluid is pumped by the submersible pump without prior filtering.

5. The well cleaning system of claim 2 in which the feed conduit has a telescopic extension in a section below the offset adjustable by a mechanical drive operated manually or automatically by a level sensor that reads a working level of the well.

6. The well cleaning system of claim 2 in which the feed conduit has a housing attached above an inlet pipe to hold an atomiser which allows a deodorizing vapor to be drawn into the conduit by the feed stream.

7. The well cleaning system of claim 1 in which the water jets rotate about a bearing mounted at the base of the vertical feed conduit.

8. The well cleaning system of claim 1 in which the water jets have deflectors mounted at an end of the jets to direct the fluid being pumped through them.

9. The well cleaning system of claim 2 in which the mounting of the apparatus at the top of the well is close to a well access and contains a swivel mechanism which allows rotation of the apparatus from one side to the other to facilitate access to the well.

10. The well cleaning system of claim 1 in which the stream of fluid is controlled automatically by solenoids and sensor switches which detect a level of fluid in the well so that when the level falls below a preset minimum a supply is activated and the jets rotate spraying residue left on well walls and when the level rises to a preset maximum the supply is shut off and the sprays cease.

11. The well cleaning system of claim 1 in which the stream of fluid contains solid materials with a diameter of up to about 50 mm.

12. The well cleaning system of claim 1 in which the stream of fluid contains solid materials having a length of up to about 90 mm.

13. The well cleaning system of claim 1 whereby said water jets are rotatably secured to said vertical feed conduit mounted at the top of said well.

14. The well cleaning system of claim 1 in which the stream of fluid contains solid materials with a length of at least 0.1 mm and up to about 90 mm.

15. The well cleaning system of claim 1 in which the stream of fluid contains solid materials with a length of at least 10 mm and up to about 90 mm.

16. The well cleaning system of claim 1 whereby said stream of unfiltered fluid is directed to spray the surface of said fluid.

17. The well cleaning system of claim 1 whereby said stream of unfiltered fluid is directed to spray one or more walls of the well whereby said unfiltered fluid impinges against said walls and removes residue attached to said wall.

18. The well cleaning system of claim 1 whereby said stream of unfiltered fluid is directed to spray one or more equipment placed within said well.

19. The well cleaning system of claim 1 further including one or more deflectors coupled to said water jets.

20. The well cleaning system of claim 1 wherein said vertical feed conduit is rotatably mounted at the top of said well.

21. The well cleaning system of claim 1 wherein said fluid having solid materials is effluent stored in said well.

22. The well cleaning system of claim 1 wherein said fluid having solid materials is sewage stored in said well.

* * * * *